US007695061B2

(12) United States Patent
Olarte

(10) Patent No.: US 7,695,061 B2
(45) Date of Patent: Apr. 13, 2010

(54) TABLET ARM ASSEMBLY

(75) Inventor: Alvaro Mauricio Olarte, Aventura, FL (US)

(73) Assignee: Series International, LLC, Miami, FL (US)

( * ) Notice: Subject to any disclaimer, the term of this patent is extended or adjusted under 35 U.S.C. 154(b) by 157 days.

(21) Appl. No.: 11/676,583

(22) Filed: Feb. 20, 2007

(65) Prior Publication Data

US 2008/0197678 A1 Aug. 21, 2008

(51) Int. Cl.
*A47B 39/06* (2006.01)

(52) U.S. Cl. ..... 297/162

(58) Field of Classification Search ..... 297/155, 297/162, 173
See application file for complete search history.

(56) References Cited

U.S. PATENT DOCUMENTS

| | | | | | |
|---|---|---|---|---|---|
| 3,102,754 | A | * | 9/1963 | Junkunc | 297/162 |
| 3,197,254 | A | * | 7/1965 | Hendrickson | 297/162 |
| 3,544,163 | A | * | 12/1970 | Krein | 297/411.32 |
| 3,547,488 | A | * | 12/1970 | Barnes | 297/162 |
| 3,550,958 | A | * | 12/1970 | Krein | 297/411.32 |
| 3,556,588 | A | * | 1/1971 | Monyer et al. | 297/162 |
| 3,784,249 | A | * | 1/1974 | Hendrickson et al. | 297/162 |
| 3,857,605 | A | | 12/1974 | Fantoni | 297/162 |
| 4,216,994 | A | | 8/1980 | Benoit | 297/162 |
| 4,575,149 | A | * | 3/1986 | Forestal et al. | 297/145 |
| 4,705,274 | A | | 11/1987 | Lubeck | |
| 4,852,940 | A | * | 8/1989 | Kanigowski | 297/145 |
| 5,087,096 | A | * | 2/1992 | Yamazaki | 297/145 |
| 5,547,247 | A | * | 8/1996 | Dixon | 297/145 |
| 5,683,136 | A | | 11/1997 | Baumann et al. | 297/162 |
| 5,765,911 | A | * | 6/1998 | Sorenson | 297/173 |
| 5,845,964 | A | | 12/1998 | Phoon | 297/162 |
| 5,931,528 | A | * | 8/1999 | Shields | 297/174 R |
| 6,012,773 | A | * | 1/2000 | Best | 297/248 |
| 6,073,997 | A | | 6/2000 | Koh | 297/173 |
| 6,224,149 | B1 | | 5/2001 | Gevaert | 297/162 |
| 6,669,282 | B2 | * | 12/2003 | Piretti | 297/162 |
| 6,729,685 | B1 | | 5/2004 | Ebalobor | |
| 6,793,281 | B2 | * | 9/2004 | Duerr et al. | 297/147 |
| 7,370,910 | B2 | * | 5/2008 | Piretti | 297/162 |
| 2005/0140186 | A1 | * | 6/2005 | Piretti | 297/162 |
| 2006/0255642 | A1 | * | 11/2006 | Epaud et al. | 297/411.38 |

FOREIGN PATENT DOCUMENTS

| | | |
|---|---|---|
| FR | 2.167.714 | 8/1973 |
| WO | 9608985 A1 | 3/1996 |

OTHER PUBLICATIONS

International Search Report and Written Opinion of the International Searaching Authority, Jun. 3, 2008 (7).

* cited by examiner

*Primary Examiner*—David Dunn
*Assistant Examiner*—James Alex
(74) *Attorney, Agent, or Firm*—St. Onge Steward Johnston & Reens LLC

(57) ABSTRACT

A tablet assembly including a tablet movable between a generally vertical stored position and a generally horizontal in-use position, and a swivel joint operable between the tablet and a mount, the swivel joint comprising an elbow, a first plate, and a second plate, wherein the first plate is rotateably attached to a first surface of the elbow and the second plate is rotateably attached to a second surface of the elbow, and wherein the first plate is fixedly attached to the mount and the second plate is fixedly attached to the tablet.

30 Claims, 12 Drawing Sheets

TABLET ARM ASSEMBLY

FIELD OF THE INVENTION

The invention relates to tablet arm assemblies, and more specifically to a tablet arm assembly rotatable with respect to a mount.

BACKGROUND OF THE INVENTION

Various writing or tablet arm assemblies which are attached to a seat assembly or arm thereof are known. Writing tablets may be fixed to an armrest or other portion of the seat assembly. However, fixed writing tablets have several disadvantages particularly with respect to a user's ease of egress from the seat assembly.

Other writing tablets are hinged and moveable between an in-use or working position and a stored position. For example, U.S. Pat. No. 5,845,964 to Phoon teaches a writing tablet movable between a stored position and an in-use position via a swivel joint interposed between the writing tablet and a frame. The swivel joint has two planar surfaces disposed at forty-five (45) degrees with respect to one another. The writing tablet is rotatable approximately one-hundred and eighty (180) degrees about the swivel joint.

While U.S. Pat. No. 5,845,964 provides an improvement over fixed writing tablets, there are still significant disadvantages. For example, the writing tablet taught by Phoon may simultaneously rotate in two orientations, i.e., about both of the two planar surfaces of the swivel joint. Therefore, in operation, the writing tablet is prone to jamming or binding up when the writing tablet rotates partially about each surface at the same time.

The writing tablet taught by Phoon also stores within the user's seating space and therefore consumes seating space and also requires the user to adjust or move his/her position to both access and store the writing tablet, or risk being impacted. Furthermore, the writing tablet extends well beyond the armrest to which it is attached at intermediate points during its rotation. Therefore, increased lateral clearance is required in the seat assembly to avoid impacting adjacent persons or objects, such as a wall. Also, the writing tablet is stored in a position extending behind the plane of the seat back, thereby in some applications consuming space in a row of the seating behind the seat to which it is attached.

U.S. Pat. No. 6,073,997 to Koh teaches a foldable table for a chair that is rotateable from a horizontal working position to a vertical storing position. The foldable table taught by Koh, however, also has several disadvantages. First, it operates above an armrest of the chair to which it is attached and substantially obstructs the armrest while the table is in its extended position. Second, the foldable table taught by Koh is not adaptable for use in a row of adjacent seats or on a seat in close proximity to an object to wall. For example, in a row of adjacent seats, the table would not only obstruct the armrest of its user but also that of an adjacent user. The foldable table also extends well beyond the armrest and into space adjacent to the seat while in the working and storing positions, and during rotation between the two positions. Like Phoon, the foldable table taught by Koh appears to also be free to simultaneously rotate in two orientations and could likely jam or bind up in operation.

It is therefore desired to provide an improved tablet arm assembly which overcomes the disadvantages of the prior art.

SUMMARY OF THE INVENTION

Accordingly, it is an object of the present invention to provide an improved tablet arm assembly including a means to prevent binding or jamming during rotation to and from a stored position.

It is a further object of the present invention to provide a tablet arm assembly rotatable in a direction away from a seated user.

It is a further object of the present invention to provide a tablet arm assembly that does not impede the space of a user or adjacent users or objects when in its stored position or during rotation thereto.

It is a further object of the present invention to provide a tablet arm assembly optimized for use in row of adjacent seats.

These and other objectives are achieved by providing a tablet assembly including a tablet movable between a generally vertical stored position and a generally horizontal in-use position, a swivel joint disposed between and operably connecting the tablet and a mount, the swivel joint having first and second generally planar surfaces defining an oblique angle with respect to one another, the swivel joint pivotably attached to the mount at the first surface which defines a first plane of rotation of the swivel joint with respect to the mount, and the swivel joint pivotably attached to the tablet at the second surface which defines a second plane of rotation of the swivel joint with respect to the tablet, wherein the tablet is movable between the stored position and the in-use position by a rotation between the swivel joint and the mount in the first plane of rotation and between the tablet and the swivel joint in the second plane of rotation, wherein, during rotation in the first plane of rotation, rotation in the second plane of rotation is locked, and wherein, during rotation in the second plane of rotation, rotation in the first plane of rotation is locked.

Other objects are achieved by providing a tablet assembly, including a tablet movable between a generally vertical stored position and a generally horizontal in-use position, and a swivel joint operable between the tablet and a mount, the swivel joint including an elbow, a first plate, and a second plate, wherein the first plate is rotateably attached to a first surface of the elbow and the second plate is rotateably attached to a second surface of the elbow, and wherein the first plate is fixedly attached to the mount and the second plate is fixedly attached to the tablet. In some embodiments, the first surface is disposed at an angle greater than sixty degrees with respect to the second surface. In some embodiments, contact between the first plate and second plate substantially prevents rotation between the second plate and the elbow during a rotation between the first plate and the elbow and, during a rotation between the second plate and the elbow, contact between the first plate and second plate substantially prevents rotation between the first plate and the elbow.

In further embodiments, contact between the first plate and second plate require the tablet to be moveable between the generally vertical stored position and the generally horizontal in-use position in two consecutive movements, wherein the first movement includes the tablet and swivel joint rotating at least 100 degrees about a first axis, and wherein the second movement includes the tablet rotating at least 90 degrees about a second axis.

Other objects are achieved by providing a tablet assembly for attachment to a seat assembly having a frame and at least one arm rest supported by the frame, the arm rest including an outer edge defining an outer vertical plane and an inner edge defining an inner vertical plane, the tablet assembly including a tablet movable between a generally vertical stored position and a generally horizontal in-use position, a swivel joint disposed between and operably connecting the tablet and the frame, the swivel joint having first and second generally planar surfaces defining an oblique angle with respect to one another, the swivel joint pivotably attached to the frame at the first surface which defines a first plane of rotation of the swivel joint with respect to the frame, and the swivel joint pivotably attached to the tablet at the second surface which defines a second plane of rotation of the swivel joint with respect to the tablet, wherein the tablet is movable between the stored position and the in-use position by rotation between the swivel joint and the frame in the first plane of rotation and between the tablet and the swivel joint in the second plane of rotation, wherein, in the stored position, the tablet is disposed under the arm rest and in a space defined between the outer vertical plane and the inner vertical plane, and wherein, as the tablet is moved between the stored position and the in-use position, no part of the tablet crosses the outer vertical plane.

Other objects are achieved by providing a seat assembly including a frame, an arm rest supported by the frame, the arm rest including an outer edge defining an outer vertical plane and an inner edge defining an inner vertical plane, a tablet movable between a generally vertical stored position and a generally horizontal in-use position by pivotable rotation about two axes obliquely angled with respect to one another, wherein, in the stored position, the tablet is disposed under the arm rest and in a space defined between the outer vertical plane and the inner vertical plane, and wherein, as the tablet is moved between the stored position and the in-use position, no part of the tablet crosses the outer vertical plane.

In some embodiments, the seat assembly includes a swivel joint disposed between and operably connecting the tablet and the frame, wherein the swivel joint includes a first plate and a second plate, wherein, during rotation about a first of the two axes, contact between at least a portion of the first plate and at least a portion of the second plate substantially prevents rotation about a second of the two axes, and wherein, during rotation about the second axis, contact between at least a portion of the first plate and at least a portion of second plate substantially prevents rotation about the first axis.

Other objects are achieved by providing a tablet assembly for attachment to a seat assembly having a frame and two arm rests supported by the frame, each of the two arm rests including an inner edge defining an inner vertical plane, with the space defined between inner vertical planes of the two arm rests defining a seating space, the tablet assembly including a tablet movable between a generally vertical stored position and a generally horizontal in-use position, a swivel joint disposed between and operably connecting the tablet and the frame, the swivel joint pivotably attached to the frame and pivotable about a first axis, and the swivel joint pivotably attached to the tablet and pivotable about a second axis, the first axis and the second axis being obliquely angled with respect to one another, wherein the tablet is movable between the stored position and the in-use position by rotation between the swivel joint and the frame about the first axis and between the tablet and the swivel joint about the second axis, wherein, in the stored position, the tablet is disposed under the arm rest and outside of the seating space of the seat assembly and adjacent seat assemblies, and wherein, as the tablet is moved between the stored position and the in-use position, no part of the tablet crosses into the seating space of adjacent seat assemblies.

In some embodiments, the swivel joint includes a first plate and a second plate, wherein, during rotation about the first axis, contact between at least a portion of the first plate and at least a portion of the second plate substantially prevents rotation about the second axis, and wherein, during rotation about the second axis, contact between at least a portion of the first plate and at least a portion of second plate substantially prevents rotation about the first axis.

Other objects, features and advantages according to the present invention will become apparent from the following detailed description of certain advantageous embodiments when read in conjunction with the accompanying drawings in which the same components are identified by the same reference numerals.

DETAILED DESCRIPTION OF THE INVENTION

Figure 1A:
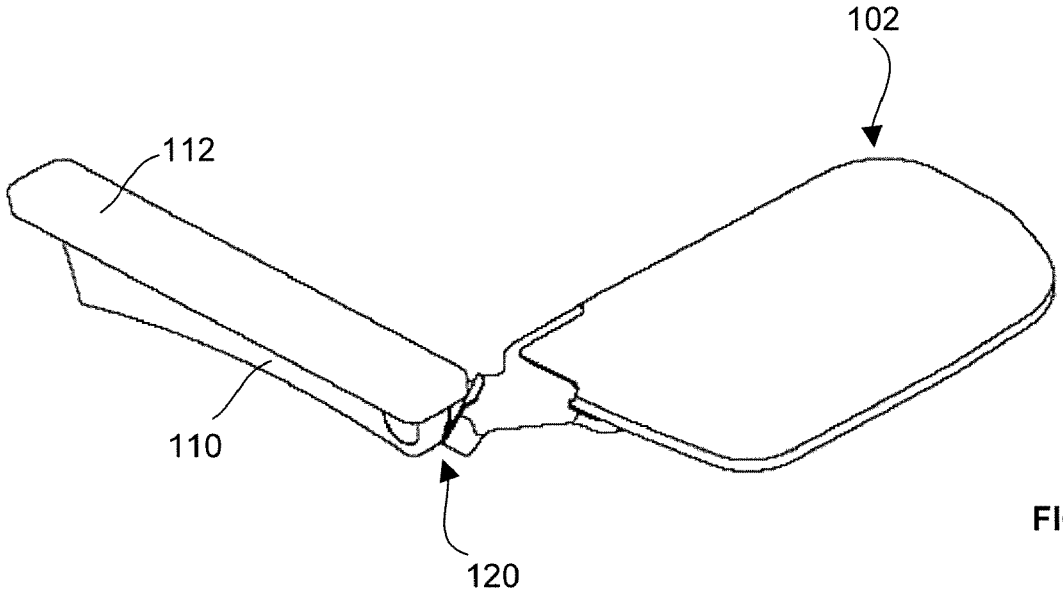
FIG. 1A is an isometric view of a tablet arm assembly according to an exemplary embodiment of the present invention in an extended position.
Figure 1B:
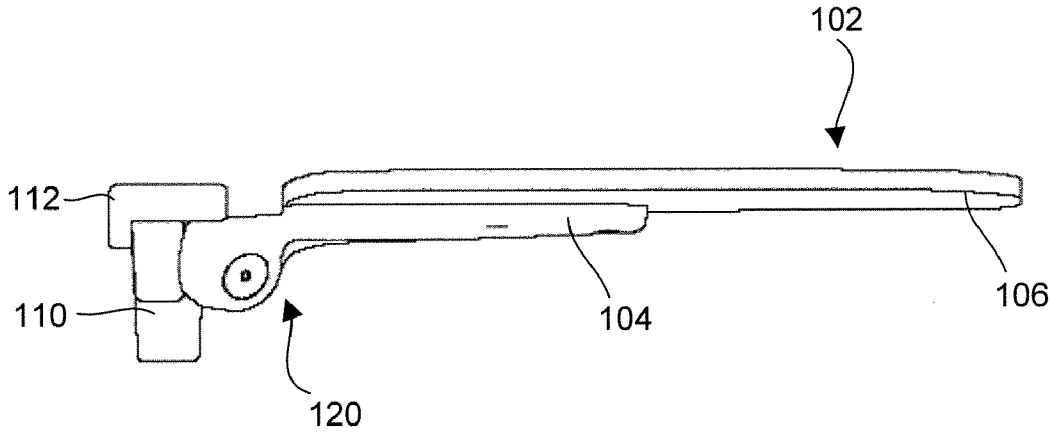
FIG. 1B is a front view of the tablet arm assembly of FIG. 1A.

FIGS. 1A and 1B show a tablet arm assembly according to an exemplary embodiment of the present invention in an extended position or in-use position. The tablet arm assembly includes a tablet portion 102. The tablet 102 may be any tablet or the like such as a writing or laptop tablet, dining table or surface, desk, work surface, support surface, etc. The tablet 102 may be single part, or may consist of two or more parts including, e.g., an angled bracket 104 and a surface 106. The surface 106 may be manufactured in a variety of thicknesses, widths, lengths and shapes. Furthermore, any number of materials may be used.

The tablet arm assembly further includes a mount 110. In the exemplary embodiment, the mount 110 is comprised in an armrest support including an arm rest portion 112. However, the mount 110 may be, e.g., a wall mount fixed to a wall or other vertical surface adjacent to a seat. The mount 110 may further be a frame, such as a seat assembly frame with or without an armrest.

Figure 2A:
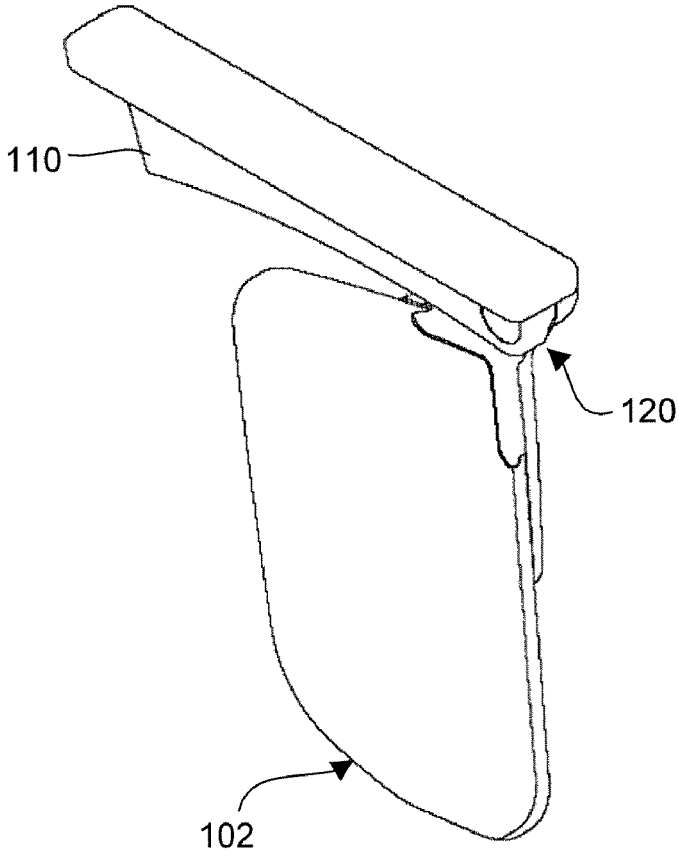
FIG. 2A is an isometric view of a tablet arm assembly according to an exemplary embodiment of the present invention in a stored position.
Figure 2B:
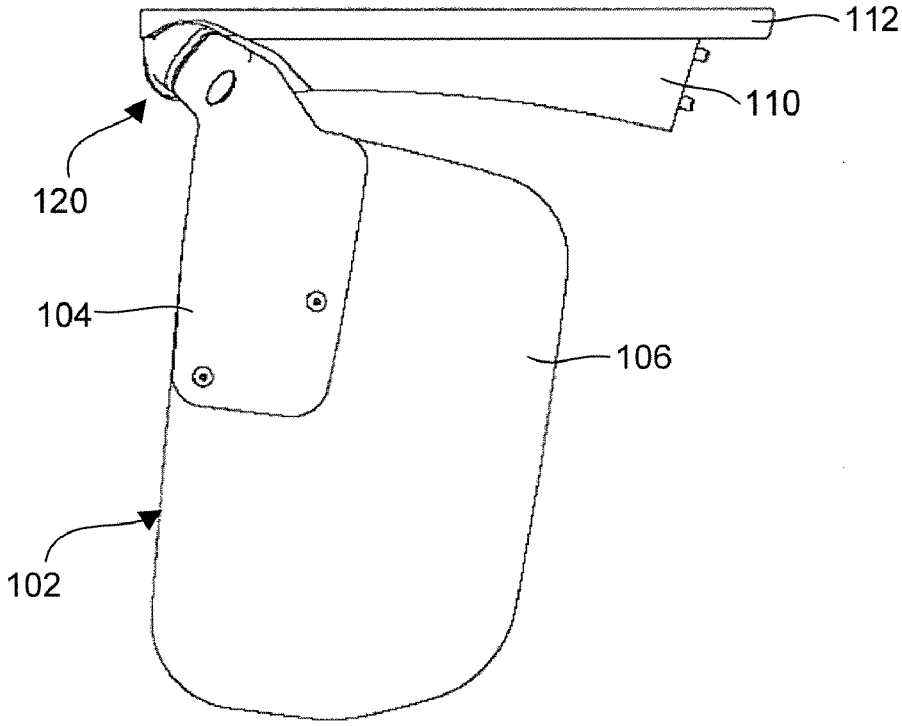
FIG. 2B is a side view of the tablet arm assembly of FIG. 2A.

The tablet arm assembly further includes a swivel joint 120 operable between the tablet 102 and the mount 110. The tablet 102 is movable between a generally vertical stored position and a generally horizontal in-use position. For example, FIGS. 2A and 2B show the tablet arm assembly in a stored position.

Figure 3:
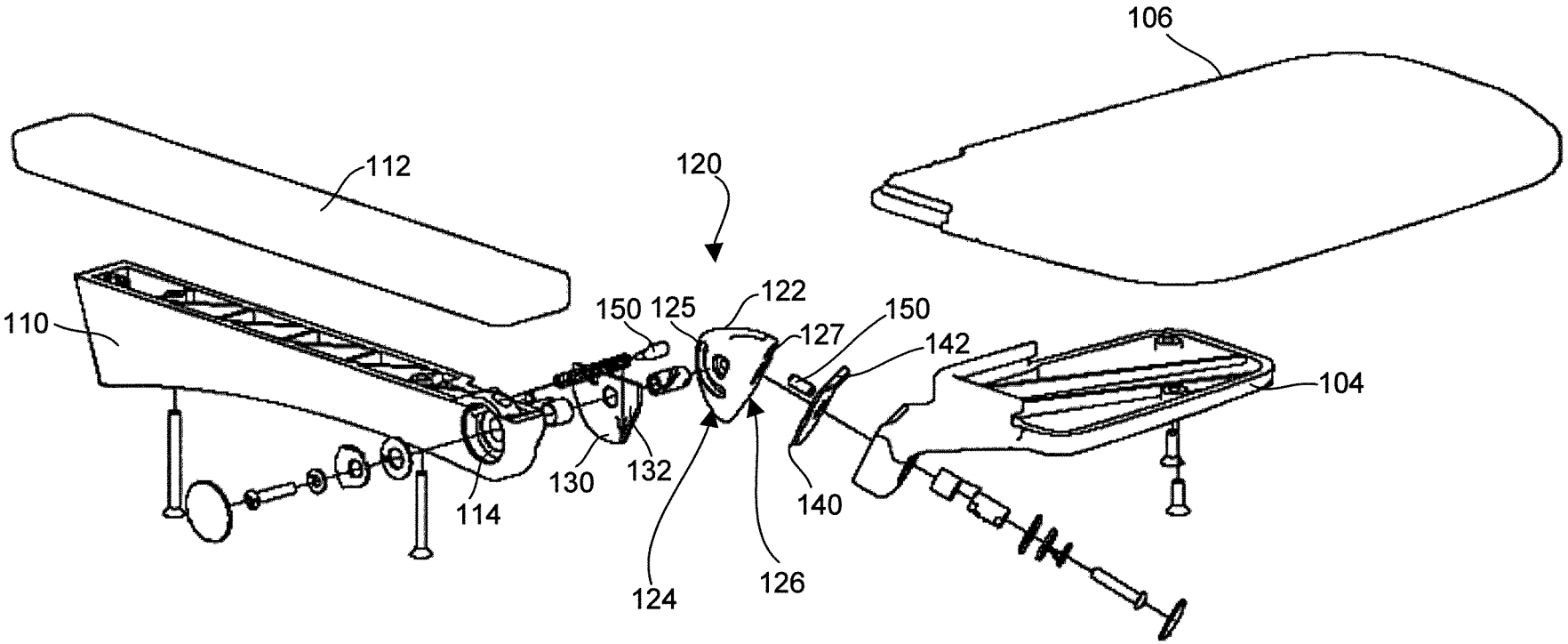
FIG. 3 is an exploded view of a tablet arm assembly according to an exemplary embodiment of the present invention.

FIG. 3 shows an exploded view of a tablet arm assembly according to an exemplary embodiment of the present invention. The mount 110 includes a connection element 114 for connecting to the swivel joint 120. The swivel joint 120 includes an elbow 122 having a first surface 124 and a second surface 126. In some embodiments, the first and second surfaces 124/126 are each generally planar and define an oblique and/or acute angle with respect to one another. In some embodiments, the angle is at least sixty (60) degrees, e.g., sixty-three (63) degrees. Each of the surfaces may further include channels 125/127 which engage pins 150, e.g., for limiting one or more ranges of rotation of the swivel joint 120.

The tablet arm assembly, and/or the swivel joint 120 thereof, further includes a first plate 130 or wedge, and a second plate 140 or wedge. The first plate 130 is rotateably attached to the first surface 124 of the elbow 122 and the second plate 140 is rotateably attached to a second surface 126 of the elbow 122. Furthermore, the first plate 130 is fixedly attached to the mount 110 and the second plate 140 to the tablet 102 (e.g., via one or more bolts and/or screws). In some embodiments, the mount 110 comprises and/or incorporates the first plate 130 and the tablet 102 comprises and/or incorporates the second plate 140. Each of the plates 130/140 may further include restrictor tabs 132/142.

As described in more detail below, the first plate 130 and second plate 140 may come into contact with one another during movement of the tablet 102 from the stored position to the extended or in-use position. During a portion of the movement which includes rotation between the first plate 130 and the elbow 122 (e.g., about a first axis normal to the first surface 124), contact between the first plate 130 and second plate 140 may substantially prevent rotation between the second plate 140 and the elbow 122 (e.g., about a second axis normal to the second surface 126). During a portion of the movement which includes rotation between the second plate 140 and the elbow 122 (e.g., about the second axis), such contact may substantially prevent rotation between the first plate 130 and the elbow 122 (e.g., about the first axis).

Figure 4A:
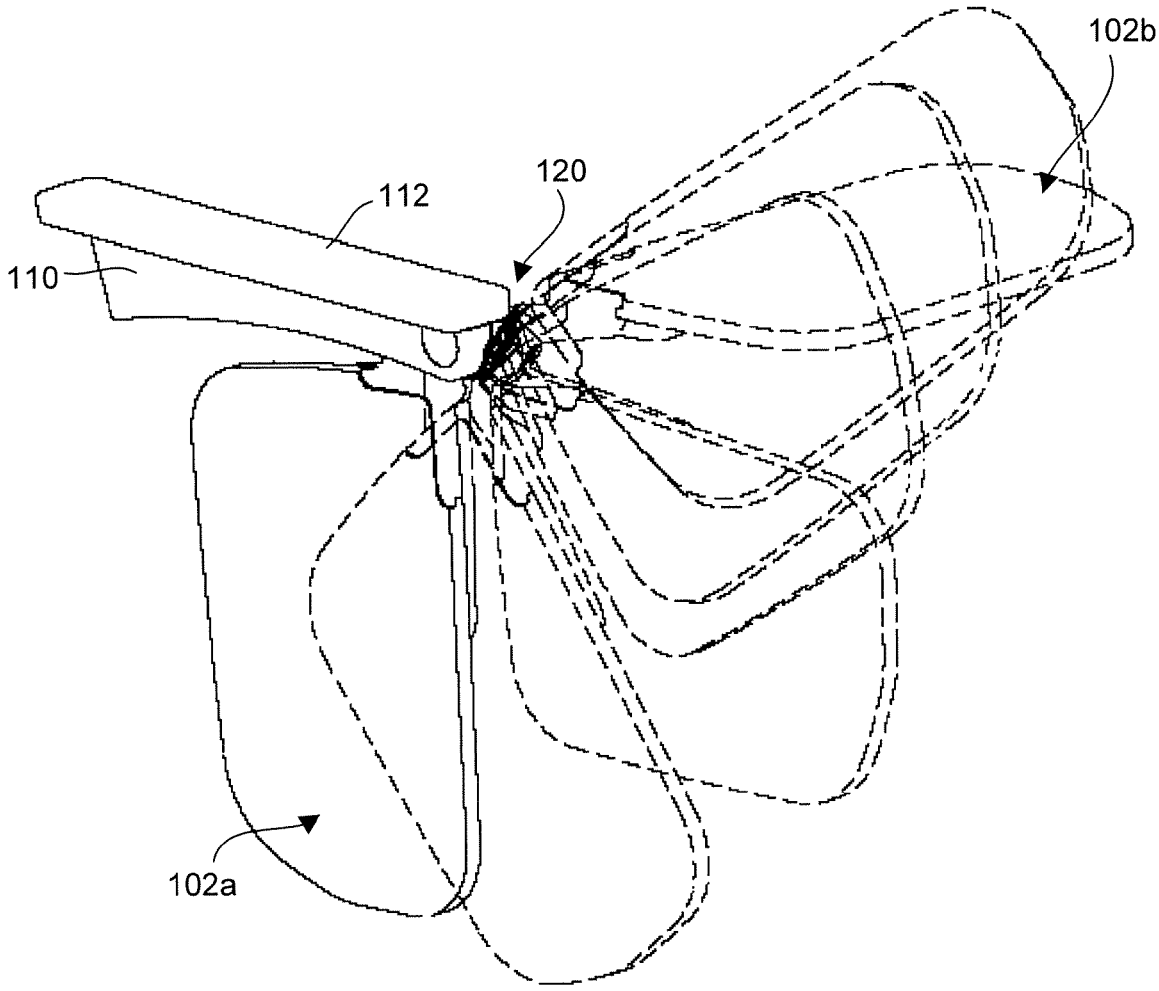
FIG. 4A is an isometric view of a path of movement of the tablet arm assembly.
Figure 4B:
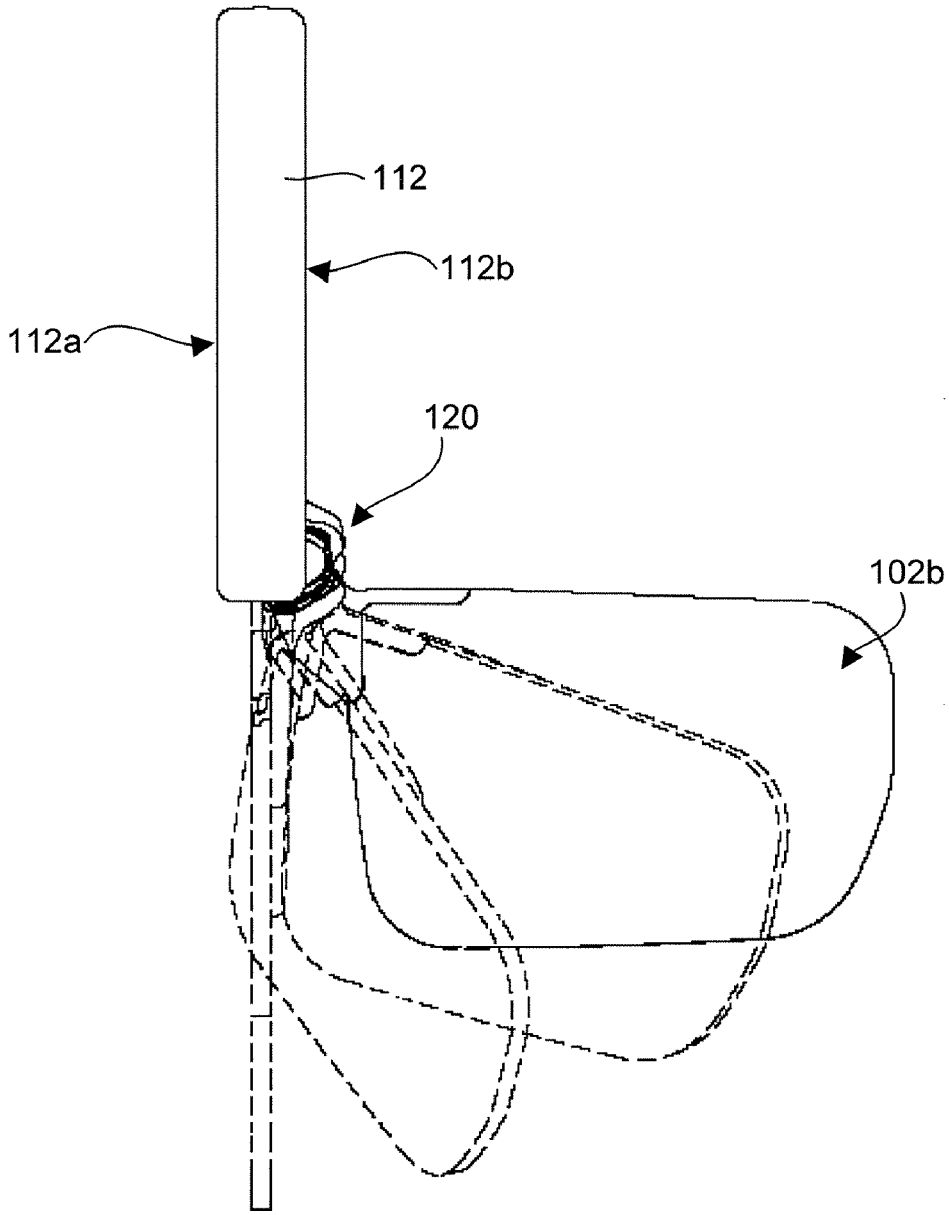
FIG. 4B is a top view of the path of movement of the tablet arm assembly shown in FIG. 4A.

FIGS. 4A and 4B illustrate an exemplary path of movement of the tablet arm assembly. The tablet 102 is moveable between the stored position 102*a*, through several intermediate positions, to the extended or in-use position 102*b*. A first portion of the movement from the stored position 102*a* to the extended position 102*b* generally includes rotation between the swivel joint 120, or elbow 122 thereof, and the mount 110 about the first axis. A second portion of the movement generally includes rotation between the tablet 102 and the swivel joint 120, or elbow 122 thereof about the second axis. While the movement is described with reference to first and second portions, it should be understood that the tablet 102 smoothly pivots between the extended and stored positions (and vice versa) and the transition between the first and second portions may be transparent to a user.

As shown in FIG. 4A, the exemplary tablet 102 operates in a general direction away from a seated user when moving to the stored position 102*a*. This direction of movement, in combination with the smooth path of movement achieved by the present invention, provides significant advantages for users. For example, a user may store the tablet 102 without the necessity to adjust his/her position to be clear of the tablet's path of movement (as is required with many prior art systems). In addition, the tablet 102 generally does not inhibit a user's immediate egress from the seat. For example, contact with the extended tablet 102*b* by either or both legs of the user, while moving from a seated position to a standing position, will send the tablet 102 to its stored position 102*a* with little or no conscious effort by the user (e.g., automatically). This is particularly advantageous for immediate egress in an emergency or panic situation, but may also be advantageous for normal egress.

In the exemplary embodiment, the tablet 102 stores beneath the armrest 112 and mount 110. For example, the tablet 102 may store between a vertical plane defined by an outer edge 112*a* of the armrest 112 and a vertical plane defined by an inner edge 112*b* of the armrest 112. As the tablet 102 is moved between the stored position 102*a* and the in-use position 102*b*, no part of said tablet 102 crosses the vertical plane defined by the outer edge 112*a*. Therefore, the tablet 102 will not interfere with adjacent users and/or objects.

Figure 5B:
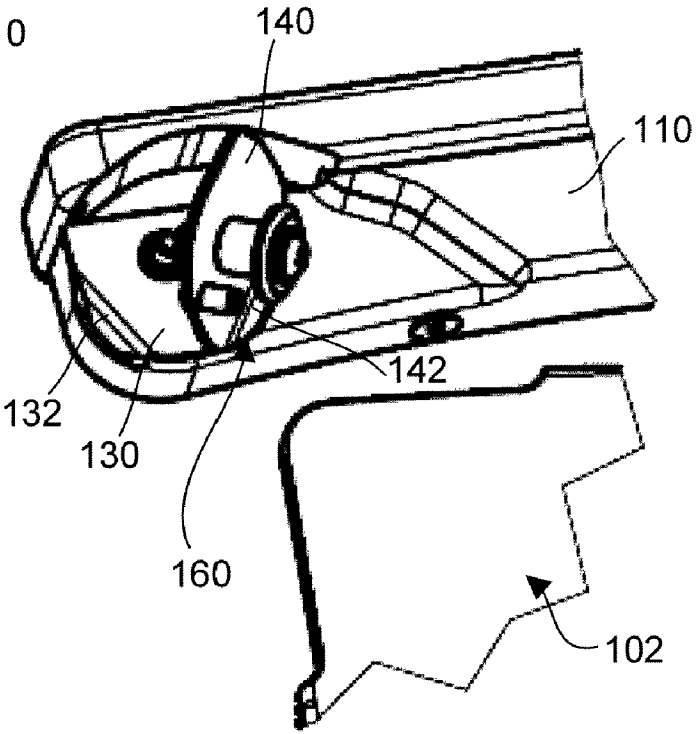
FIG. 5B is a cutaway side view of the swivel joint shown in FIG. 5A.
Figure 5A:
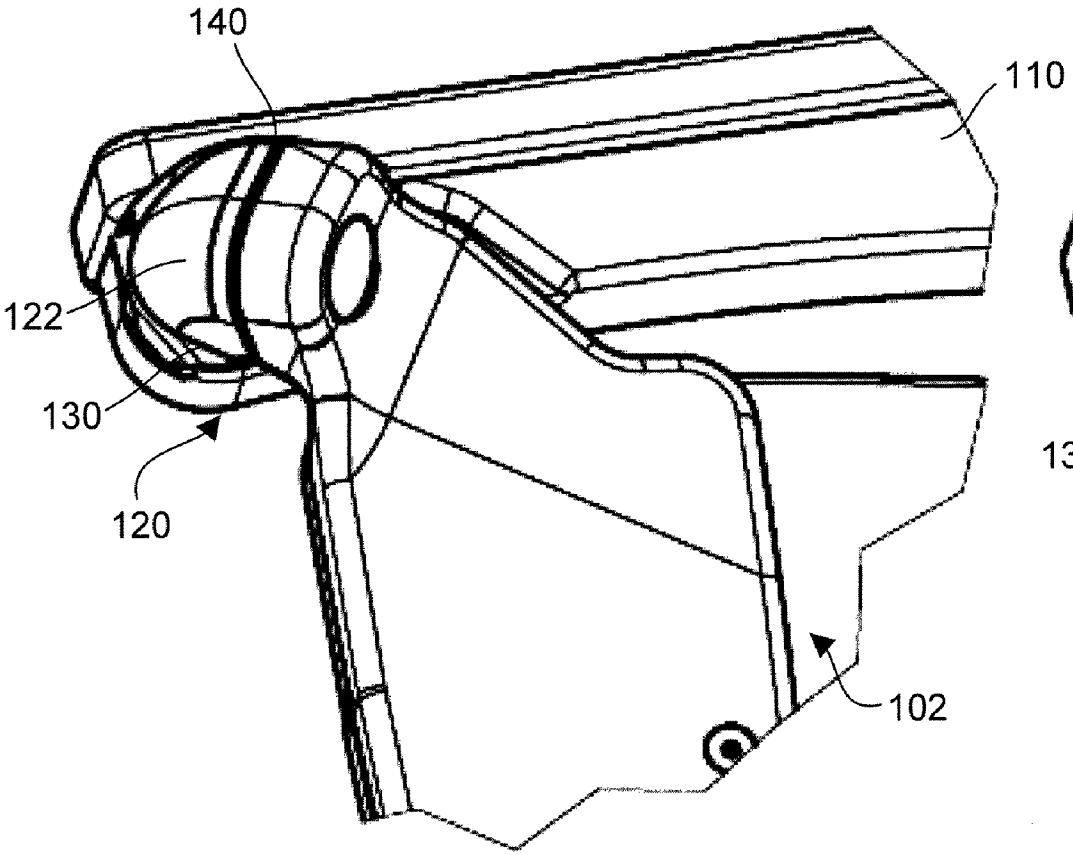
FIG. 5A is a side view of a swivel joint of a tablet arm assembly according to an exemplary embodiment of the present invention.

FIGS. 5A-6D illustrate the swivel joint 120 during movement of the tablet 102 from the stored position to the extended or in-use position. In particular, FIGS. 5A and 5B show side views of the swivel joint 120 while the tablet 102 is in the stored position. The first plate 130 and second plate 140 are in close proximity and/or in contact in or around a contact area 160. In particular, the restrictor tab 142 of the second plate 140 is in close proximity to the first plate 130. As such, rotation between the elbow 122 and the mount 110 (e.g., about the first axis) is possible, however rotation between the tablet 102 and elbow 122 (e.g., about the second axis) is locked or restricted.

Figure 6B:
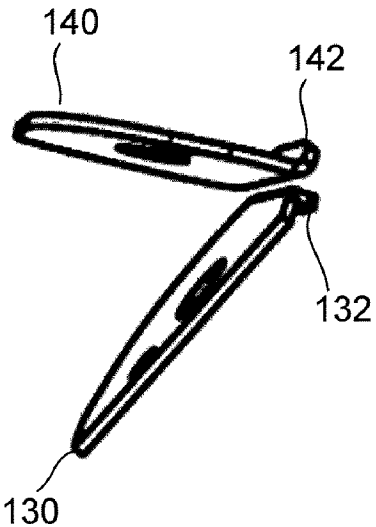
FIG. 6B is an isometric view of two plates of the swivel joint and tablet arm assembly shown in FIG. 6A.
Figure 6A:
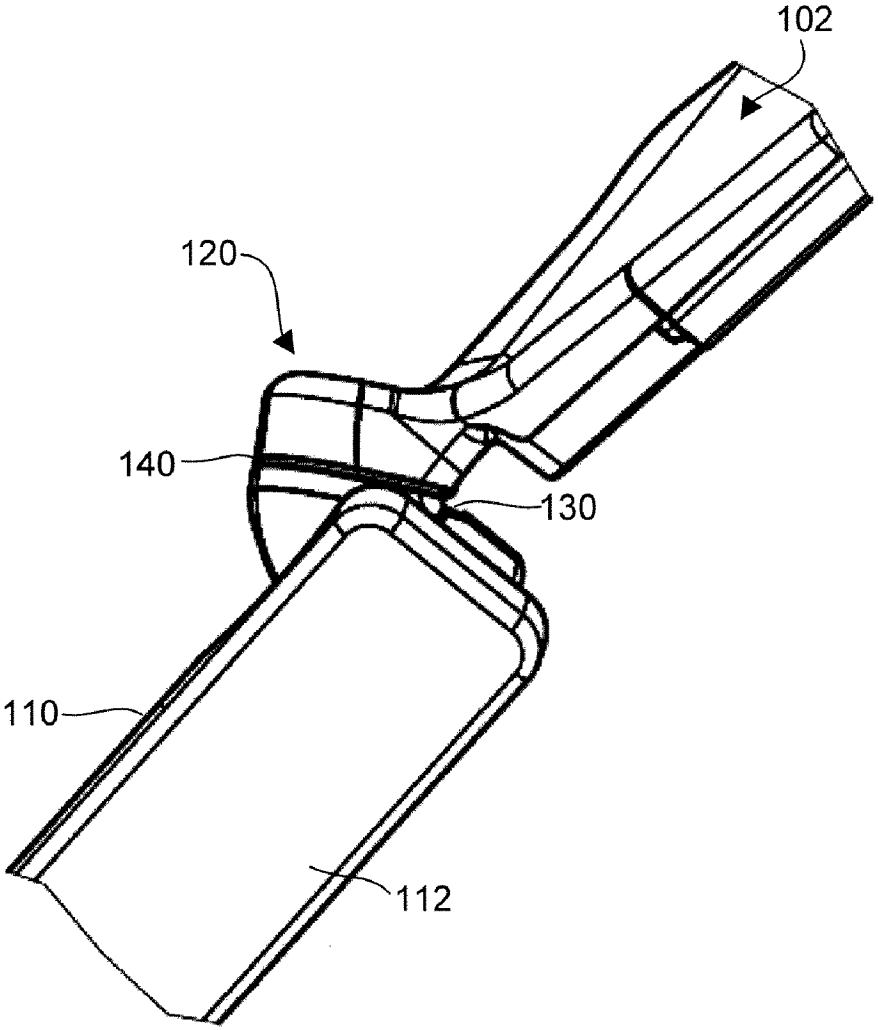
FIG. 6A is a top view of a swivel joint of an exemplary tablet arm assembly in a partially extended position.

FIGS. 6A and 6B show top views of the tablet arm assembly and swivel joint in an intermediate position between the stored position and extended position. At the intermediate position, the first portion of the movement (e.g., about the first axis and/or between the swivel joint 120 and the mount 110) is substantially complete. In some embodiments, the first movement includes a rotation of greater than one-hundred degrees. In a preferred embodiment, the first movement includes a rotation of approximately one hundred and seventeen (117) degrees about the first axis. The first plate 130 and second plate 140 are generally not in contact during the intermediate position. As such, the tablet 102 may be returned to the stored position (e.g., rotated about the first axis) or continued to the extended position (e.g., rotated about the second axis).

Figure 6C:
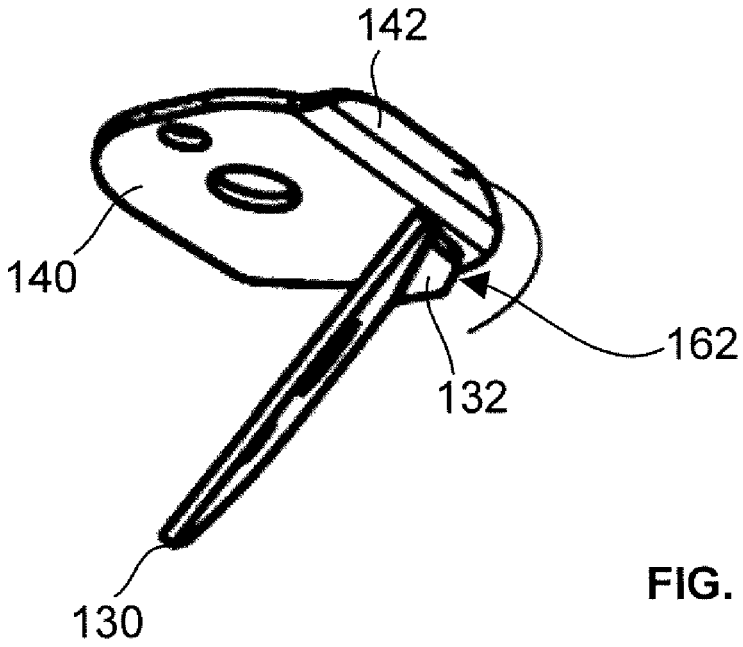
FIG. 6C is another isometric view of the two plates shown in FIG. 6B.
Figure 6D:
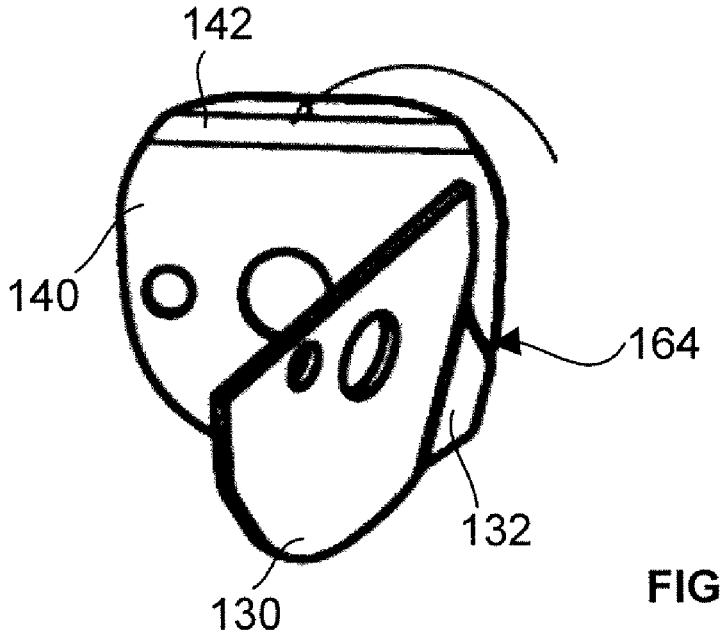
FIG. 6D is another isometric view of the two plates shown in FIG. 6B.

FIG. 6C shows the plates 130/140 at a position between the intermediate position and the extended position. In the shown position, the tablet arm has completed approximately fifty five (55) degrees of rotation in the second movement (e.g., about the second axis). The first plate 130 and second plate 140 are in contact or at least close proximity in a contact area 162 and the first movement (e.g., about the first axis) is restricted and/or locked. The second movement continues until the tablet 102 is in a substantially horizontal position, shown in FIG. 6D. For example, the second movement may include a rotation of at least ninety (90) degrees about the second surface 126. In a preferred embodiment, the second movement includes a rotation of one hundred and four (104) degrees about the second surface 126. In the extended position, movement about the first surface 124 is restricted and/or locked due at least in part to contact (e.g., or potential contact) between the restrictor tab 132 and the second plate 140 in the contact area 164.

Figure 7A:
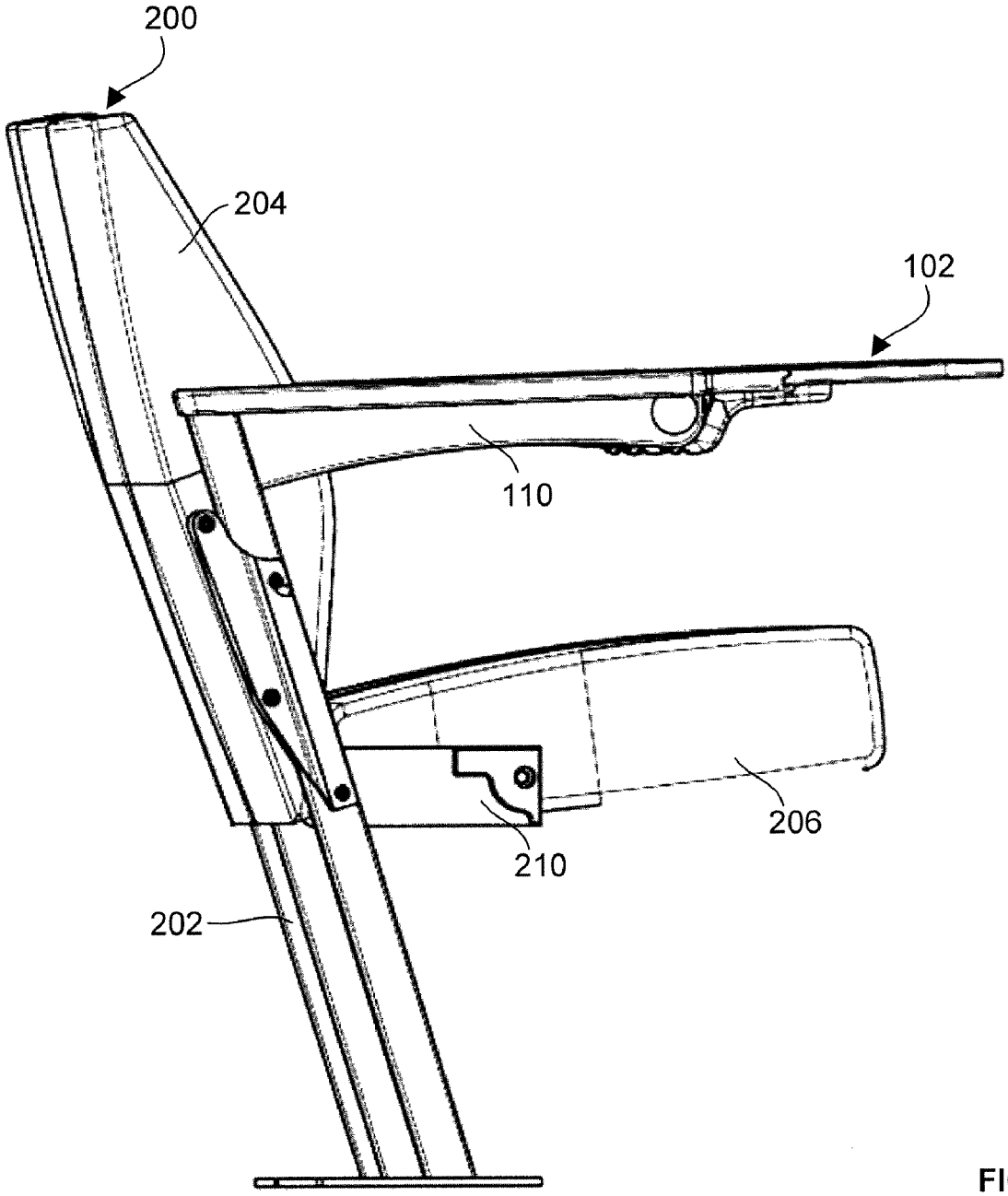
FIG. 7A is a side view of a seat assembly including a tablet arm according to an exemplary embodiment of the present invention in an extended position.
Figure 7B:
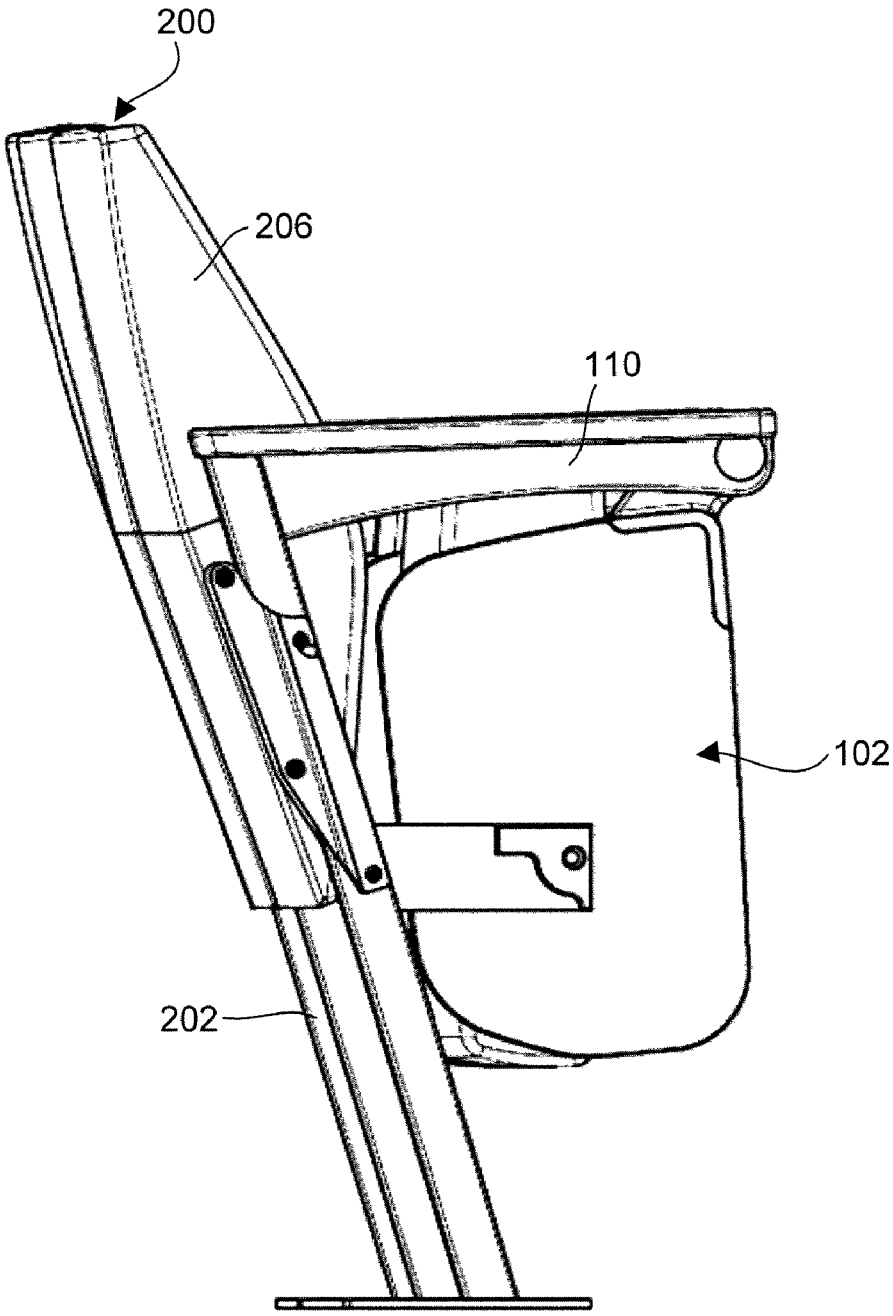
FIG. 7B is a side view of the seat assembly shown in FIG. 7A wherein the tablet arm is in a stored position.

FIGS. 7A-8B show exemplary seat assemblies incorporating the tablet arm according to the present invention. For example, FIGS. 7A and 7B show an exemplary seat assembly 200 including the tablet arm assembly. The seat assembly 200 includes a frame 202, a seat back 204 and a seat bottom 206. The seat bottom 206 is rotateable about a seat connection mechanism 210. Although the tablet assembly and/or tablet 102 is shown fixed to a right side of the seat assembly 200, one of ordinary skill in the art will understand that the tablet arm assembly may be configured for attachment to a left side of the seat assembly 200 if desired. Such a tablet arm assembly would generally be a mirror image of the exemplary embodiments shown herein. However, the tablet arm assembly according to the present invention is generally useable by both right and left handed individuals despite which side it is mounted.

Figure 8A:
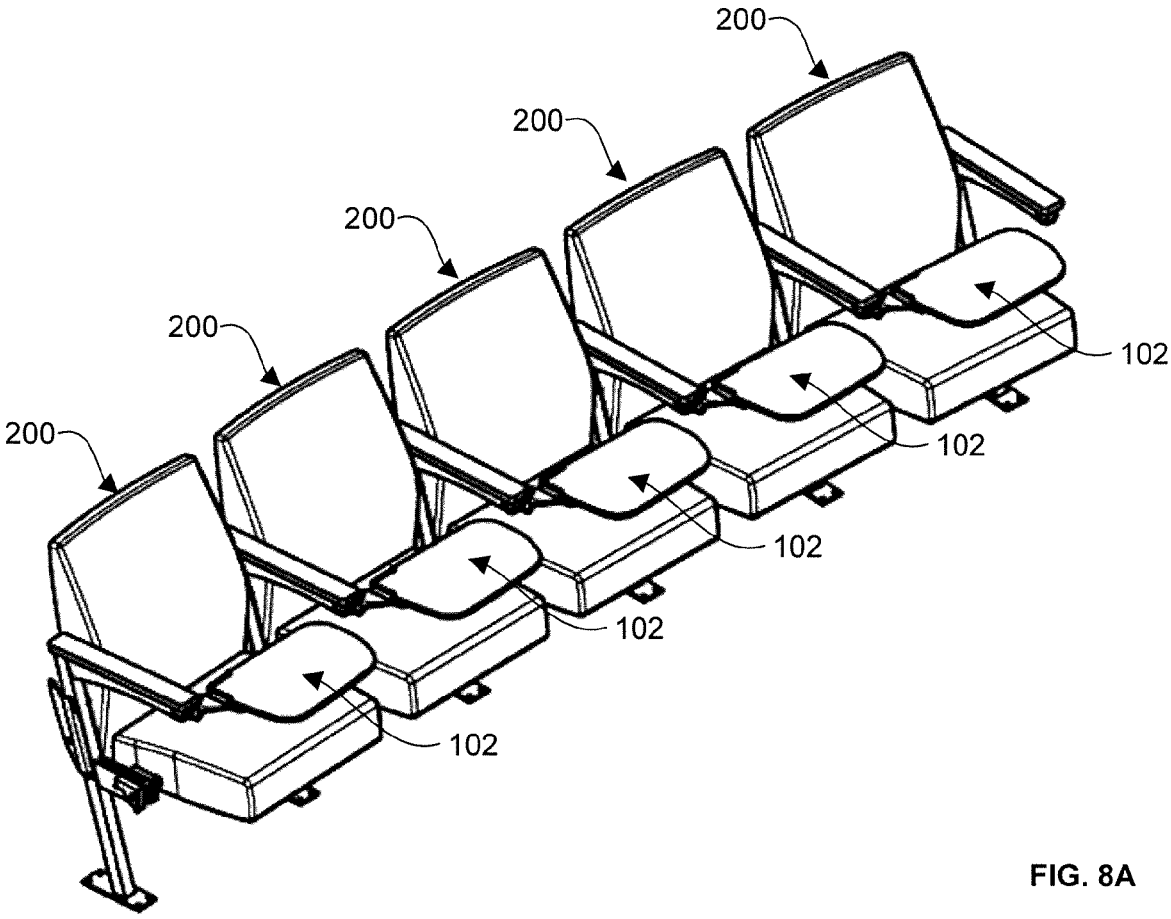
FIG. 8A is an isometric view of a seat assembly including a plurality of tablet arms in extended positions according to an exemplary embodiment of the present invention.
Figure 8B:
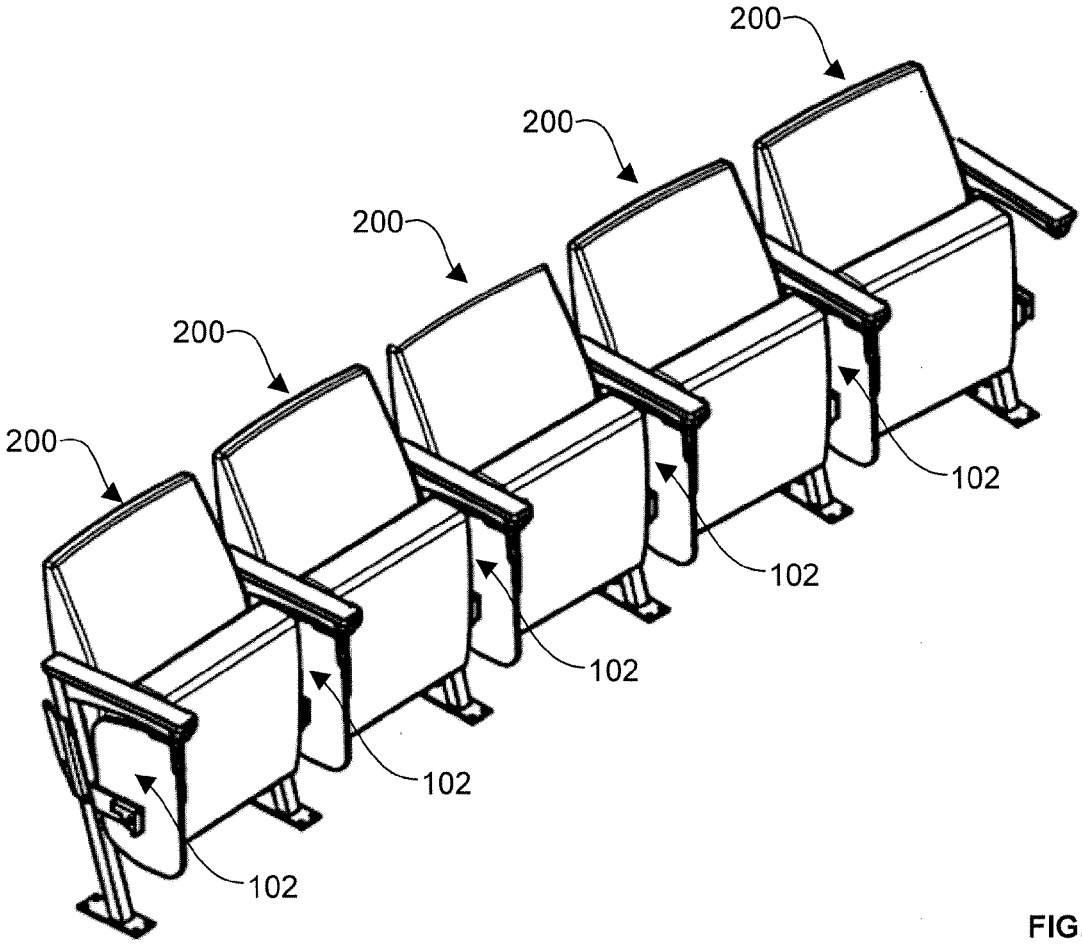
FIG. 8B is an isometric view of the seat assembly shown in FIG. 8A wherein the plurality of tablet arms are in stored positions.

FIGS. 8A and 8B show seat assemblies including multiple seat backs 204, seat bottoms 206 and tablet arm assemblies and/or tablets 102. In the exemplary embodiment, each seat includes two armrests (e.g., shared armrests). Each armrest includes an inner edge defining an inner vertical plane and the space between inner vertical planes of the two arm rests of a particular seat defines a seating space. In the stored position, each tablet 102 is disposed under the arm rest and outside of the seating space of both the particular seat to which it pertains and each adjacent seat. As the tablet is moved between the stored position and the in-use position, no part of the tablet 102 crosses beyond the armrest or into the seating space of adjacent seats.

Although the invention has been described with reference to a particular arrangement of parts, features and the like, these are not intended to exhaust all possible arrangements or features, and indeed many modifications and variations will be ascertainable to those of skill in the art.

What is claimed is:

1. A tablet assembly, comprising:

a tablet movable between a generally vertical stored position and a generally horizontal in-use position;

a swivel joint disposed between and operably connecting said tablet and a mount, said swivel joint having first and second generally planar surfaces defining an oblique angle with respect to one another, said swivel joint pivotably attached to the mount at the first surface which defines a first plane of rotation of said swivel joint with respect to the mount, and said swivel joint pivotably attached to said tablet at the second surface which defines a second plane of rotation of said swivel joint with respect to said tablet;

wherein said tablet is movable between the stored position and the in-use position by a rotation between said swivel joint and the mount in the first plane of rotation and between said tablet and said swivel joint in the second plane of rotation;

wherein, during rotation in the first plane of rotation, rotation in the second plane of rotation is locked; and wherein, during rotation in the second plane of rotation, rotation in the first plane of rotation is locked.

2. The tablet assembly according to claim 1, wherein, at an intermediate position, each of the rotation about the first plane of rotation and rotation about the second plane of rotation is unlocked.

3. The tablet assembly according to claim 1, wherein the rotation about the first plane of rotation is at least 100 degrees and rotation about the second plane of rotation is at least 90 degrees.

4. The tablet assembly according to claim 1, wherein the mount is fixed to a wall.

5. The tablet arm assembly according to claim 1, wherein the tablet moves from the in-use position to the stored position automatically upon the egress of a seated user by contact between said tablet and one or more legs of the user when the user moves forward from a seated position to a standing position.

6. The tablet assembly according to claim 1, said mount including a generally planar mount attachment surface in pivotal contact with the first surface of the swivel joint and a first tab at an oblique angle with respect to the mount attachment surface;

said tablet including a generally planar tablet attachment surface in pivotal contact with the second surface of the swivel joint and a second tab at an oblique angle with respect to the tablet attachment surface;

wherein, during the rotation in the first plane of rotation, the rotation in the second plane of rotation is locked by contact between the mount attachment surface and the second tab; and wherein, during the rotation in the second plane of rotation, the rotation in the first plane of rotation is locked by contact between the first tab and the tablet attachment surface.

7. The tablet assembly according to claim 1, wherein the oblique angle is at least sixty degrees.

8. The tablet assembly according to claim 1, wherein said mount is connectable to a seat, wherein said tablet moves from the generally horizontal in-use position above the seat to the generally vertical stored position adjacent to the seat by a single contact with said tablet in a direction of forward egress from the seat.

9. A tablet assembly, comprising:

a tablet movable between a generally vertical stored position and a generally horizontal in-use position; and a swivel joint operable between said tablet and a mount, said swivel joint comprising an elbow, a first plate, and a second plate, wherein the first plate is fixedly attached to the mount and the second plate is fixedly attached to said tablet;

the first plate including a generally planar attachment surface rotateably attached to a first surface of the elbow and a first tab at an obligue angle with respect to the attachment surface of the first plate;

the second plate including a generally planar attachment surface rotateably attached to a second surface of the elbow and a second tab at an oblique angle with respect to the attachment surface of the second plate; and wherein, during a rotation between the first plate and the elbow, contact between the attachment surface of the first plate and the second tab substantially prevents rotation between the second plate and the elbow; and wherein, during a rotation between the second plate and the elbow, contact between the first tab and the attachment surface of the second plate substantially prevents rotation between rotation between the first plate and the elbow.

10. The tablet according to claim 9, wherein, during movement of said tablet between the generally vertical stored position and the generally horizontal in-use position, said tablet rotates at least 100 degrees about an axis normal to the first surface and said tablet rotates at least 90 degrees about an axis normal to the second surface.

11. The tablet assembly according to claim 9, wherein the mount is a wall mount.

12. The tablet assembly according to claim 9, further comprising:

a seat assembly frame, wherein said seat assembly frame comprises the mount.

13. The tablet assembly according to claim 9, further comprising:

wherein the mount includes an armrest.

14. The tablet assembly according to claim 9, wherein said tablet comprises a work surface and a bracket, the bracket being fixedly attached to the second plate.

15. The tablet assembly according to claim 9, wherein the mount comprises the first plate and the tablet comprises the second plate.

16. The tablet arm assembly according to claim 9, wherein the tablet moves from the in-use position to the stored position automatically upon the egress of a seated user by contact between said tablet and one or more legs of the user when the user moves forward from a seated position to a standing position.

17. The tablet assembly according to claim 9, wherein the first plate is incorporated into the mount and the second plate is incorporated into said tablet.

18. A tablet assembly, comprising:

a tablet movable between a generally vertical stored position and a generally horizontal in-use position; and a swivel joint operable between said tablet and a mount, said swivel joint comprising an elbow, a first plate, and a second plate, wherein the elbow includes first and second planar surfaces defining an oblique angle with respect to one another, wherein the first plate is rotateably attached to the first surface of the elbow and the second plate is rotateably attached to the second surface of the elbow, wherein the first surface is disposed at an angle of at least sixty degrees with respect to the second surface, wherein the first plate is fixedly attached to the mount and the second plate is fixedly attached to said tablet, wherein contact between the first plate and second plate require said tablet to be moveable between the generally vertical stored position and the generally horizontal in-use position in two consecutive movements, wherein the first movement includes said tablet and swivel joint rotating at least 100 degrees about a first axis, and wherein said second movement includes said tablet rotating at least 90 degrees about a second axis.

19. The tablet assembly according to claim 18, wherein the first axis is normal to the first surface and the second axis is normal to the second surface.

20. A tablet assembly for attachment to a seat assembly having a frame and at least one arm rest supported by the frame, the arm rest comprising an outer edge defining an outer vertical plane and an inner edge defining an inner vertical plane, said tablet assembly comprising:

a tablet movable between a generally vertical stored position and a generally horizontal in-use position;

a swivel joint disposed between and operably connecting said tablet and the frame, said swivel joint having first and second generally planar surfaces defining an oblique angle with respect to one another, said swivel joint pivotably attached to the frame at the first surface which defines a first plane of rotation of said swivel joint with respect to the frame, and said swivel joint pivotably attached to said tablet at the second surface which defines a second plane of rotation of said swivel joint with respect to said tablet;

wherein said tablet is movable between the stored position and the in-use position by rotation between said swivel joint and the frame in the first plane of rotation and between said tablet and said swivel joint in the second plane of rotation;

wherein, in the stored position, said tablet is disposed under the arm rest and in a space defined between the outer vertical plane and the inner vertical plane;

wherein, as the tablet is moved between the stored position and the in-use position, no part of said tablet crosses the outer vertical plane; and wherein, as the tablet moves between the in-use position and the stored position, said tablet moves into the space and under the arm rest without displacing the arm rest.

21. The tablet assembly according to claim 20, wherein, during rotation between said swivel joint and the frame in the first plane of rotation, rotation between said tablet and said swivel joint in the second plane of rotation is locked; and wherein, during rotation between said tablet and said swivel joint in the second plane of rotation, rotation between said swivel joint and the frame in the first plane of rotation is locked.

22. The tablet assembly according to claim 20, wherein the oblique angle is at least sixty degrees.

23. The tablet assembly according to claim 20, said frame including a generally planar frame attachment surface in pivotal contact with the first surface of the swivel joint and a first tab at an oblique angle with respect to the frame attachment surface;

said tablet including a generally planar tablet attachment surface in pivotal contact with the second surface of the swivel joint and a second tab at an oblique angle with respect to the tablet attachment surface;

wherein, during the rotation in the first plane of rotation, the rotation in the second plane of rotation is locked by contact between the frame attachment surface and the second tab; and wherein, during the rotation in the second plane of rotation, the rotation in the first plane of rotation is locked by contact between the first tab and the tablet attachment surface.

24. A tablet assembly for attachment to a seat assembly having a frame and at least one arm rest supported by the frame, the arm rest comprising an outer edge defining an outer vertical plane and an inner edge defining an inner vertical plane, said tablet assembly comprising:

a tablet movable between a generally vertical stored position and a generally horizontal in-use position;

a swivel joint disposed between and operably connecting said tablet and the frame, said swivel joint having first and second generally planar surfaces defining an oblique angle with respect to one another, said swivel joint pivotably attached to the frame at the first surface which defines a first plane of rotation of said swivel joint with respect to the frame, and said swivel joint pivotably attached to said tablet at the second surface which defines a second plane of rotation of said swivel joint with respect to said tablet;

wherein said tablet is movable between the stored position and the in-use position by rotation between said swivel joint and the frame in the first plane of rotation and between said tablet and said swivel joint in the second plane of rotation;

wherein, in the stored position, said tablet is disposed under the arm rest and in a space defined between the outer vertical plane and the inner vertical plane;

wherein, as the tablet is moved between the stored position and the in-use position, no part of said tablet crosses the outer vertical plane;

wherein said swivel joint comprises a first plate and a second plate, wherein, during rotation about the first plane of rotation, contact between at least a portion of the first plate and at least a portion of the second plate substantially prevents rotation about the second plane of rotation, and wherein, during rotation about the second plane of rotation, contact between at least a portion of the first plate and at least a portion of second plate substantially prevents rotation about the first plane of rotation.

25. A tablet assembly for attachment to a seat assembly having a frame and two arm rests supported by the frame, each of the two arm rests comprising an inner edge defining an inner vertical plane, with the space defined between inner vertical planes of the two arm rests defining a seating space, said tablet assembly comprising:

a tablet movable between a generally vertical stored position and a generally horizontal in-use position;

a swivel joint disposed between and operably connecting said tablet and the frame, said swivel joint pivotably attached to the frame and pivotable about a first axis, and said swivel joint pivotably attached to said tablet and pivotable about a second axis, the first axis and the second axis being obliquely angled with respect to one another;

wherein said tablet is movable between the stored position and the in-use position by rotation between said swivel joint and the frame about the first axis and between said tablet and said swivel joint about the second axis;

wherein, in the stored position, said tablet is disposed under one of the two arm rests and outside of the seating space of the seat assembly and adjacent seat assemblies;

wherein, as the tablet is moved between the stored position and the in-use position, no part of said tablet crosses into the seating space of adjacent seat assemblies; and wherein, as the tablet moves between the in-use position and the stored position, said tablet moves under the one arm rest without displacing the one arm rest.

26. The tablet assembly according to claim 25, wherein, during rotation about the first axis, rotation about the second axis is locked; and wherein, during rotation about the second axis, rotation about the first axis is locked.

27. The tablet assembly according to claim 25, wherein said swivel joint comprises a first plate and a second plate, wherein, during rotation about the first axis, contact between at least a portion of the first plate and at least a portion of the second plate substantially prevents rotation about the second axis, and wherein, during rotation about the second axis, contact between at least a portion of the first plate and at least a portion of second plate substantially prevents rotation about the first axis.

28. A tablet assembly, comprising:

a mount comprising a mount attachment surface;

a tablet movable between a generally vertical stored position and a generally horizontal in-use position, said tablet comprising a tablet attachment surface;

a swivel joint operable between said tablet and said mount, wherein the mount attachment surface is rotateably attached to a first surface of said swivel joint and the tablet attachment surface is rotateably attached to a second surface of said swivel joint, wherein the first and second surfaces of said swivel joint define an oblique angle with respect to one another;

wherein, during a rotation between said mount and said swivel joint, contact between the mount attachment surface and the tablet attachment surface substantially prevents rotation between said tablet and said swivel joint; and wherein, during a rotation between said tablet and said swivel joint, contact between the mount attachment surface and the tablet attachment surface substantially prevents rotation between said mount and said swivel joint.

29. The tablet assembly according to claim 28, wherein the oblique angle is at least sixty degrees.

30. The tablet assembly according to claim 28, wherein said mount is connectable to a seat, wherein said tablet moves from the generally horizontal in-use position above the seat to the generally vertical stored position adjacent to the seat by a single contact with said tablet in a direction of forward egress from the seat.

* * * * *